United States Patent [19]

Salestrom et al.

[11] Patent Number: 4,639,841

[45] Date of Patent: Jan. 27, 1987

[54] MODULAR LIGHTING SYSTEM

[76] Inventors: Charles B. Salestrom, No. 2 Seminole La.; Kenneth E. Anderson, No. 9 N. Lake Dr., both of Kearney, Nebr. 68847

[21] Appl. No.: 817,988

[22] Filed: Jan. 13, 1986

[51] Int. Cl.[4] ..... F21M 33/00

[52] U.S. Cl. ..... 362/227; 362/249; 362/246; 339/23

[58] Field of Search ..... 362/227, 249, 246; 339/20, 21, 23, 24, 157 C

[56] References Cited

U.S. PATENT DOCUMENTS

| | | | |
|---|---|---|---|
| 2,175,145 | 10/1939 | Davison | 339/23 |
| 2,320,332 | 5/1943 | Morten | 339/23 |
| 3,633,023 | 1/1972 | Castiglioni | 313/1 |
| 4,070,594 | 1/1978 | Fuchi | 313/1 |
| 4,413,311 | 11/1983 | Orenstein | 362/219 |
| 4,488,082 | 12/1984 | Cummins | 313/1 |
| 4,555,749 | 11/1985 | Rifkin | 362/249 |

FOREIGN PATENT DOCUMENTS

| | | | |
|---|---|---|---|
| 1060556 | 8/1979 | Canada | 339/24 |
| 175441 | 5/1935 | Switzerland | 339/23 |

*Primary Examiner*—E. Rollins Cross

*Attorney, Agent, or Firm*—Zarley, McKee, Thomte, Voorhees & Sease

[57] ABSTRACT

A modular lighting system is described comprising a plurality of elongated light modules which are selectively connected in an end-to-end relationship to achieve the desired light length. Each of the light modules have a female plug portion on one end thereof and a male plug portion on the other end thereof. The desired number of light modules may be secured together in an end-to-end relationship by inserting the male plug portion of one light module into the female plug portion of an adjacent light module. The light modules are provided with a plurality of light bulbs mounted thereon and a reflector positioned at one side thereof.

7 Claims, 5 Drawing Figures

MODULAR LIGHTING SYSTEM

BACKGROUND OF THE INVENTION

Various types of light or lighting systems are presently being employed to provide indirect lighting for such areas as soffits, toe spaces, under cabinets, cabinet interiors, etc. Fluorescent lights have been used in such areas but they do not provide the soft lighting which is desirable. Further, the fluorescent lights normally come in fixed lengths and such fixed lengths make them difficult to install in areas having varying lengths.

It is therefore a principal object to provide a lighting system comprised of light modules which may be connected together in an end-to-end relationship to achieve the desired length.

A further object of the invention is to provide a modular lighting system of the incandescent type.

Yet another object of the invention is to provide a modular lighting system which permits the interconnection of interconnected light modules located in spaced-apart locations.

Still another object of the invention is to provide a modular lighting system which is easy to install.

Still another object of the invention is to provide a modular lighting system including a mounting means for mounting the same.

Yet another object of the invention is to provide a modular lighting system including a reflector means.

Still another object of the invention is to provide a modular lighting system which is economical of manufacture, durable in use and refined in appearance.

These and other objects will be apparent to those skilled in the art.

SUMMARY OF THE INVENTION

A modular lighting system is described which permits a plurality of individual light modules to be connected together in an end-to-end relationship to provide a light having the desired length to accommodate the particular area being illuminated. The lighting system of this invention comprises a plurality of individual light modules each of which have a male plug portion at one end thereof and a female plug portion at the other end thereof. An electric circuit interconnects the male and female plug portions so that the male plug portion of a light module may be inserted into the female plug portion of an adjacent light module. A plurality of light bulbs are mounted on each of the light modules and a reflector is provided at one side thereof.

DESCRIPTION OF THE PREFERRED EMBODIMENT

Figure 1:
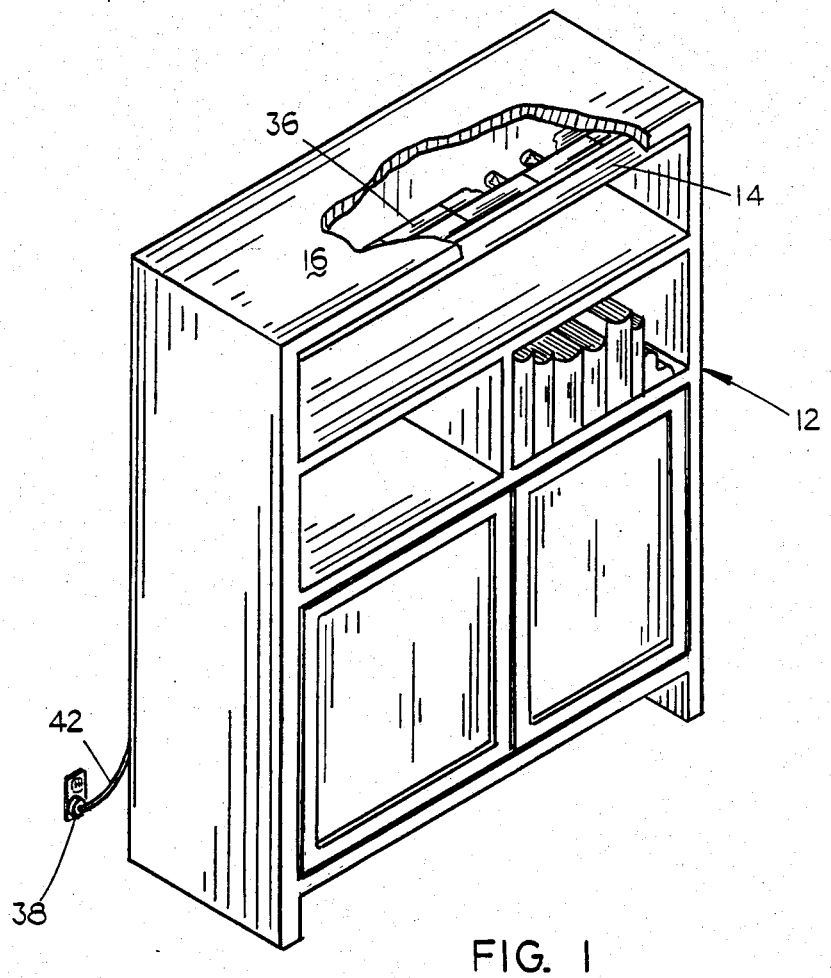
FIG. 1 is a perspective view of a cabinet or the like having the lighting system of this invention mounted therein.

The modular lighting system of this invention is referred to generally by the reference numeral 10 and is designed to be mounted in any space or area requiring indirect lighting. For example, FIG. 1 illustrates a cabinet 12 having a fascia board 14 provided at the upper front portion thereof extending downwardly from top 16. Since top 16 has a fixed length, it would be difficult and inconvenient to mount a single fluorescent bulb or the like which extended across the entire width of the cabinet. An alternative to such an arrangement would be to individually mount two or more fluorescent bulbs behind the fascia board 14. Such an arrangement would be difficult and would not provide the desired lighting effect.

The lighting system 10 of this invention is comprised of a plurality of individual light modules 18 which may be selectively connected in an end-to-end relationship so as to achieve the desired length. Each of the modules 18 comprises an elongated body member 20 having a quadrilateral cross-section. A male plug portion 22 is provided at one end of body member 20 from which protrudes connector elements 24. A female plug portion 26 is provided at the other end of body member 20 and is provided with two sockets at the inner end thereof. An electric circuit 30 interconnects the connector elements 24 with the sockets 28. As seen in the drawings, female plug portion 26 has a dimension such that it may receive the male plug portion 22 from an adjacent light module 18.

Each of the modules 18 is provided with a plurality of light sockets 32 which are electrically connected to the circuit 30 and which are adapted to receive light bulb 34 therein. The numeral 36 refers to a metal reflector positioned at one side of the bulbs 34 as seen in the drawings.

Figure 3:
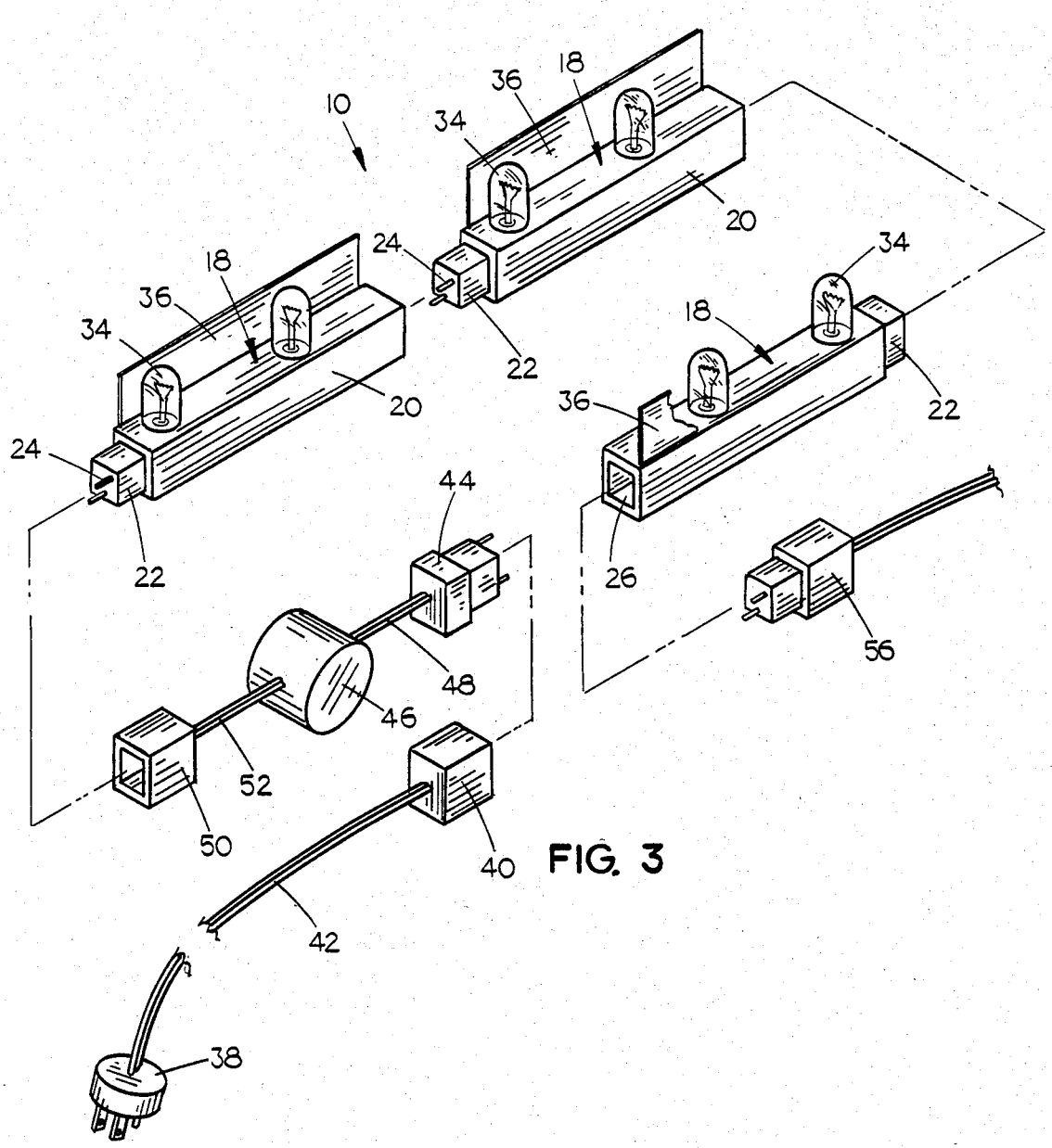
FIG. 3 is an exploded perspective view of the lighting system of this invention.
Figure 4:
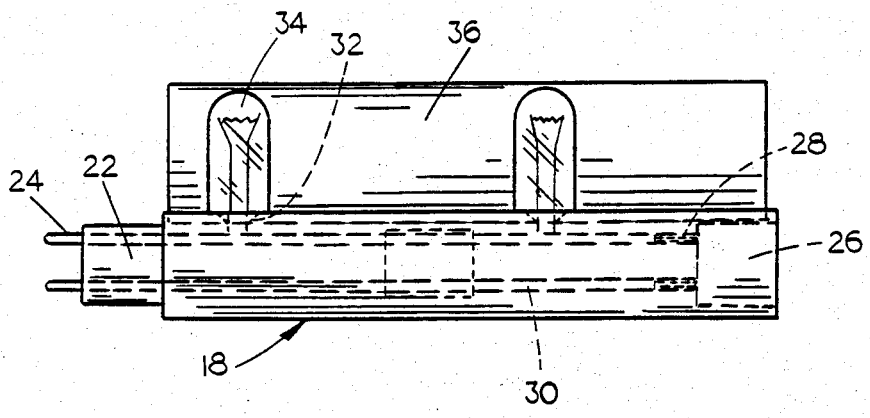
FIG. 4 is a side elevational view of one of the light modules.
Figure 5:
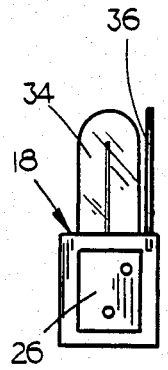
FIG. 5 is an end view of the light module of FIG. 4.

The proper number of the modules 18 may be interconnected in an end-to-end relationship to achieve tne desired length as stated. The endmost light module 18 must be connected to a source of electrical power. The light module 18 is connected to the source of electrical or energy in the manner illustrated in FIG. 3 wherein the numeral 38 refers to a wall plug connected to a connector 40 by wires 42. Connector 40 is adapted to receive and to be electrically connected to the plug 44 which is electrically connected to the transformer 46 by wires 48. Transformer 46 is connected to female connector 50 by wires 52. Transformer 46 is adapted to reduce the voltage from 120 volts to the desired level.

Figure 2:
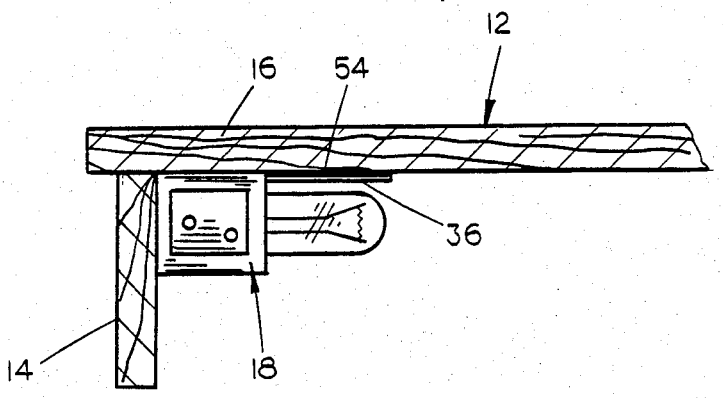
FIG. 2 is a sectional view of the cabinet of FIG. 1 illustrating the lighting system of this invention mounted therein.

When it is desired to mount the light modules, the desired number of light modules 18 are interconnected in the end-to-end relationship by inserting the male plug portions into the female plug portions as previously described. The modules 18 are then positioned as illustrated in FIG. 2 and secured to the underside of top 12 by means of double faced tape 54 or by some other suitable connector such as a Velcro fastener system. Connector 50 is then secured to the endmost light module 18 and the connector 44 is secured to the connector 40. If desired, a switch or the like may be imposed in either of the wires 42 or 48. When power is supplied to the light modules 18, a soft incandescent light is supplied and reflector 36 serves to reflect the light downwardly from the module 18.

A distinct advantage in the light module system described herein is that a group of light modules 18 may be mounted in separated areas of a cabinet or the like and electrically interconnected by means of the electrical harness 56. In other words, three of the light modules 18 may be connected together and positioned in one space and electrically connected to additional light modules positioned in a location or area spaced from the same and interconnected by the harness 56. The interconnection of the light modules of this invention provides the ability to achieve a light system of the desired length with the same being able to be connected to lights in other areas of a cabinet or the like. The profile or configuration of the light modules permits the light modules to be mounted in such areas as soffits, toe spaces, under cabinets, etc.

Thus it can be seen that the invention accomplishes at least all of its stated objectives.

I claim:

1. A modular lighting system, comprising, a plurality of elongated light modules selectively connected in an end-to-end relationship, each of said elongated light modules having a male plug portion at one end thereof and a female plug portion at its other end, first electric circuit means electrically connecting said male and female plug portions, a plurality of light sockets provided on each of said modules and being electrically connected to said first electric circuit means, a light bulb means in each of said light sockets, the male plug portion of each of said modules adapted to be:

(1) received by the female plug portion of the adjacent module, or:

(2) electrically connected to a source of electrical energy, or:

(3) electrically connected to a female plug portion of a module separated therefrom whereby the length of the modular lighting system may be varied by the use of more or less modules.

2. The system of claim 1 wherein mounting means is provided on each of said modules for mounting the modules on a supporting surface.

3. The system of claim 1 wherein each of said modules has a quadrilateral cross-section.

4. The system of claim 1 wherein a reflector means is mounted on each of said modules at one side of said light bulbs.

5. A modular lighting system, comprising, a plurality of elongated light modules selectively connected in an end-to-end relationship, each of said elongated light modules having a male plug portion at one end thereof and a female plug portion at its other end, an electrical harness having a male plug portion at one end and a female plug portion at its other end, first electric circuit means electrically connecting said male and female plug portions in said light modules, second electric circuit means electrically connecting said male and female plug portions in said electrical harness, a plurality of light sockets provided on each of said light modules and being electrically connected to said first electric circuit means, a light bulb means in each of said light sockets, the male plug portion of each of said modules adapted to be:

(1) received by the female plug portion of an adjacent light module, or:

(2) electrically connected to a source of electrical energy, or:

(3) received by the female plug portion of the electrical harness whereby the length of the modular lighting system may be varied by the use of more or less modules, and the male plug portion of said electrical harness adapted to be:

(1) received by the female plug portion of an adjacent light module, or:

(2) electrically connected to a source of electrical energy, whereby a light module connected to the female plug portion of said electrical harness is separated from the light module connected to the male portion or the source of electrical energy.

6. The modular lighting system of claim 5, wherein said second electric circuit means within the electrical harness includes at least two flexible electrical wires, whereby the male and female plug portions of the electrical harness may be selectively oriented in relation to one another.

7. The modular lighting system of claim 5, further comprising, a transformer for reducing the voltage of the source of electrical energy, said transformer having a male plug portion at one end thereof and a female plug portion at its other end, third electric circuit means electrically connecting said male plug portion to an input portion of said transformer, fourth electric circuit means electrically connecting an output portion of said transformer to said female plug portion, the male plug portion of said transformer adapted to be electrically connected to a source of electrical energy, and the female plug portion of said electrical transformer adapted to be:

(1) received by the male plug portion of an adjacent light module, or:

(2) received by the male plug portion of the electrical harness.

* * * * *